US011951589B2

(12) United States Patent
Zhang et al.

(10) Patent No.: US 11,951,589 B2
(45) Date of Patent: Apr. 9, 2024

(54) WAFER EDGE ASYMMETRY CORRECTION USING GROOVE IN POLISHING PAD

(71) Applicant: Applied Materials, Inc., Santa Clara, CA (US)

(72) Inventors: Jimin Zhang, San Jose, CA (US); Jianshe Tang, San Jose, CA (US); Brian J. Brown, Palo Alto, CA (US); Wei Lu, Fremont, CA (US); Priscilla Diep, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 327 days.

(21) Appl. No.: 16/953,139

(22) Filed: Nov. 19, 2020

(65) Prior Publication Data

US 2021/0154796 A1 May 27, 2021

Related U.S. Application Data

(60) Provisional application No. 62/939,538, filed on Nov. 22, 2019.

(51) Int. Cl.
*B24B 37/26* (2012.01)
*B24B 37/005* (2012.01)
(Continued)

(52) U.S. Cl.
CPC ..... *B24B 37/26* (2013.01); *B24B 37/005* (2013.01); *B24B 37/042* (2013.01); *B24B 37/27* (2013.01)

(58) Field of Classification Search
CPC ..... B24B 37/26; B24B 37/005; B24B 37/042; B24B 37/046; B24B 37/27; B24B 37/013;
(Continued)

(56) References Cited

U.S. PATENT DOCUMENTS 5,421,769 A 6/1995 Schultz et al.
5,558,563 A 9/1996 Cote et al.
(Continued)

FOREIGN PATENT DOCUMENTS

CN 101190508 A * 6/2008 ..... B24B 37/26
JP H06-031617 2/1994
(Continued)

OTHER PUBLICATIONS

English translation of CN 101190508A (Year: 2008).*
(Continued)

*Primary Examiner* — Joel D Crandall
*Assistant Examiner* — Sukwoo James Chang
(74) *Attorney, Agent, or Firm* — Fish & Richardson P.C.

(57) ABSTRACT

A chemical mechanical polishing system includes a platen to hold a polishing pad, a carrier head to hold a substrate against a polishing surface of the polishing pad, and a controller. The polishing pad has a polishing control groove. The carrier is laterally movable by a first actuator across the polishing pad and rotatable by a second actuator. The controller synchronizes lateral oscillation of the carrier head with rotation of the carrier head such that over a plurality of successive oscillations of the carrier head such that when a first angular swath of an edge portion of the substrate is at an azimuthal angular position about an axis of rotation of the carrier head the first angular swath overlies the polishing surface and when a second angular swath of the edge portion of the substrate is at the azimuthal angular position the second angular swath overlies the polishing control groove.

19 Claims, 9 Drawing Sheets

(51) Int. Cl.
*B24B 37/04* (2012.01)
*B24B 37/27* (2012.01)

(58) Field of Classification Search
CPC ..... B24B 37/04; B24B 37/07; B24B 37/10; B24B 37/105; B24B 57/02; B24B 7/228; B24B 49/04; B24B 49/10; H01L 21/67092
USPC ..... 451/1
See application file for complete search history.

(56) References Cited

U.S. PATENT DOCUMENTS

| | | | |
|---|---|---|---|
| 7,097,534 | B1 | 8/2006 | Yampolskiy et al. |
| 7,927,182 | B2 | 4/2011 | Swedek et al. |
| 10,357,867 | B2 | 7/2019 | Lin et al. |
| 2005/0136804 | A1 | 6/2005 | Miyake et al. |
| 2008/0020683 | A1 | 1/2008 | Doi et al. |
| 2008/0125019 | A1 | 5/2008 | Jiang et al. |
| 2008/0311823 | A1 | 12/2008 | Aiyoshizawa et al. |
| 2014/0020829 | A1 | 1/2014 | Hung et al. |
| 2017/0256414 | A1 | 9/2017 | Liu et al. |
| 2017/0274496 | A1* | 9/2017 | Cook ..... B24B 37/26 |
| 2018/0236630 | A1 | 8/2018 | Yasuda et al. |
| 2018/0250788 | A1* | 9/2018 | Lau ..... H01L 21/31053 |
| 2018/0264619 | A1 | 9/2018 | Yoshida et al. |
| 2018/0290263 | A1 | 10/2018 | Sotozaki et al. |
| 2020/0331114 | A1 | 10/2020 | Wu et al. |
| 2020/0331117 | A1 | 10/2020 | Wu et al. |

FOREIGN PATENT DOCUMENTS

| | | | | |
|---|---|---|---|---|
| JP | 2000-094303 | | 4/2000 | |
| JP | 2008-188768 | | 8/2008 | |
| JP | 2009283538 | A * | 12/2009 | ..... B24B 37/00 |
| JP | 2010-186917 | | 8/2010 | |
| KR | 10-2005-0106904 | | 11/2005 | |
| TW | 201611946 | | 4/2016 | |
| WO | WO2008114805 | A1 * | 9/2008 | ..... B24B 37/00 |
| WO | WO 2008114805 | A1 * | 9/2008 | ..... B24B 37/00 |

OTHER PUBLICATIONS

English translation of JP 2009283538A (Year: 2009).*
English translation of WO 2008/114805A1 (Year: 2008).*
PCT International Search Report and Written Opinion in International Appln. No. PCT/US2020/061334, dated Feb. 24, 2021, 14 pages.
Office Action in Taiwanese Appln. No. 109140217, dated Oct. 3, 2021, 11 pages (with English Search Report).
Office Action in Taiwanese Appln. No. 109140217, dated Jan. 20, 2022, 6 pages (with English summary).
Office Action in Japanese Appln. No. 2022-529774, dated Jun. 27, 2023, 11 pages (with English translation).

* cited by examiner

WAFER EDGE ASYMMETRY CORRECTION USING GROOVE IN POLISHING PAD

CROSS-REFERENCE TO RELATED APPLICATIONS

This application claims priority to U.S. Application Ser. No. 62/939,538, filed on Nov. 22, 2019, the disclosure of which is incorporated by reference.

TECHNICAL FIELD

The present disclosure relates to chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One issue in polishing is non-uniformity in the polishing rate across the substrate. For example, the edge portion of a substrate can polish at a higher relative to the central portion of the substrate.

SUMMARY

In one aspect, a chemical mechanical polishing system includes a rotatable platen to hold a polishing pad, a rotatable carrier head to hold a substrate against a polishing surface of the polishing pad during a polishing process, and a controller. The platen is rotatable by a motor, and the polishing pad has a polishing control groove concentric with an axis of rotation for the polishing pad. The carrier is laterally movable by a first actuator across the polishing pad and rotatable by a second actuator. The controller is configured to control the first actuator and the second actuator to synchronize lateral oscillation of the carrier head with rotation of the carrier head such that over a plurality of successive oscillations of the carrier head such that when a first angular swath of an edge portion of the substrate is at an azimuthal angular position about an axis of rotation of the carrier head the first angular swath overlies the polishing surface and when a second angular swath of the edge portion of the substrate is at the azimuthal angular position the second angular swath overlies the polishing control groove.

Implementations may include one or more of the following features.

The polishing pad may have comprises slurry-supply grooves, and the slurry supply grooves may be narrower than the polishing control groove. The polishing pad may have a single polishing control groove surrounding the slurry supply grooves, a single polishing control groove surrounded by the slurry supply grooves, or exactly two polishing control grooves with the slurry supply grooves positioned between the two polishing control grooves. The controller may be configured to control the first actuator and the second actuator such that a first frequency of rotation of the carrier head is equal to an integer multiple of a second frequency of lateral oscillation of the carrier head.

In another aspect, a chemical mechanical polishing system includes a rotatable platen to hold a polishing pad, a rotatable carrier head to hold a substrate against a polishing surface of the polishing pad during a polishing process, and a controller. The platen is rotatable by a motor, and the polishing pad has a polishing control groove concentric with an axis of rotation for the polishing pad, the polishing groove having a plurality of arcuate segments. The carrier head is rotatable by an actuator. The controller is configured to control the motor and the actuator to synchronize rotation of the platen with rotation of the carrier head such that over a plurality of successive rotations of the carrier head when a first angular swath of an edge portion of the substrate is at a azimuthal angular position about the axis of rotation the carrier head the second angular swath overlies a region of the polishing surface between arcuate segments and when a second angular swath of the edge portion of the substrate is at then azimuthal angular position the second angular swath overlies an arcuate segment of the polishing control groove.

Implementations may include one or more of the following feature.

The arcuate segments may be spaced at equal angular intervals around the axis of rotation of the platen. The arcuate segments may have equal lengths. Each arcuate segment may subtend an arc of 10-45°. There are four to twenty arcuate segments. The polishing pad further may have slurry-supply grooves, and the slurry supply grooves may be narrower than the polishing control groove. The controller is configured to control the motor and the actuator such that a first frequency of rotation of the carrier head is an integer multiple of a second frequency of rotation of the platen.

Improvements can include, but are not limited to, one or more of the following. Non-uniformity, and particularly angularly asymmetric non-uniformity near the substrate edge, can be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

In chemical mechanical polishing, removal rates at the edge portion of the substrate can be different from removal rates at the central portion of the substrate. In addition, the polishing rate near the substrate edge need not be uniform along the circumference; this effect can be termed "edge asymmetry." To address a resulting irregularity in substrate thickness, a substrate could be transported to a dedicated polishing "touch up" tool that can polish local regions on the substrate. Such a tool can be used to correct substrate edge asymmetry. For example, after the polishing process is completed, thicker regions at the edge of the substrate can be locally polished to provide a uniformly thick substrate. However, the throughput for such touch-up tools is low, and the touch-up tools add an additional cost and footprint in the fabrication facility.

A technique that could address this problem is synchronizing rotation of the carrier head with lateral motion of the carrier head or rotation of the platen to preferentially position over-polished regions of the substrate over a polishing control groove. This technique can reduce non-uniformity, particularly edge asymmetry, in the polished substrate. Moreover, the technique can be applied in the chemical mechanical polishing tool itself, thus avoiding significant capital expenses or installation of new tools.

Figure 1:
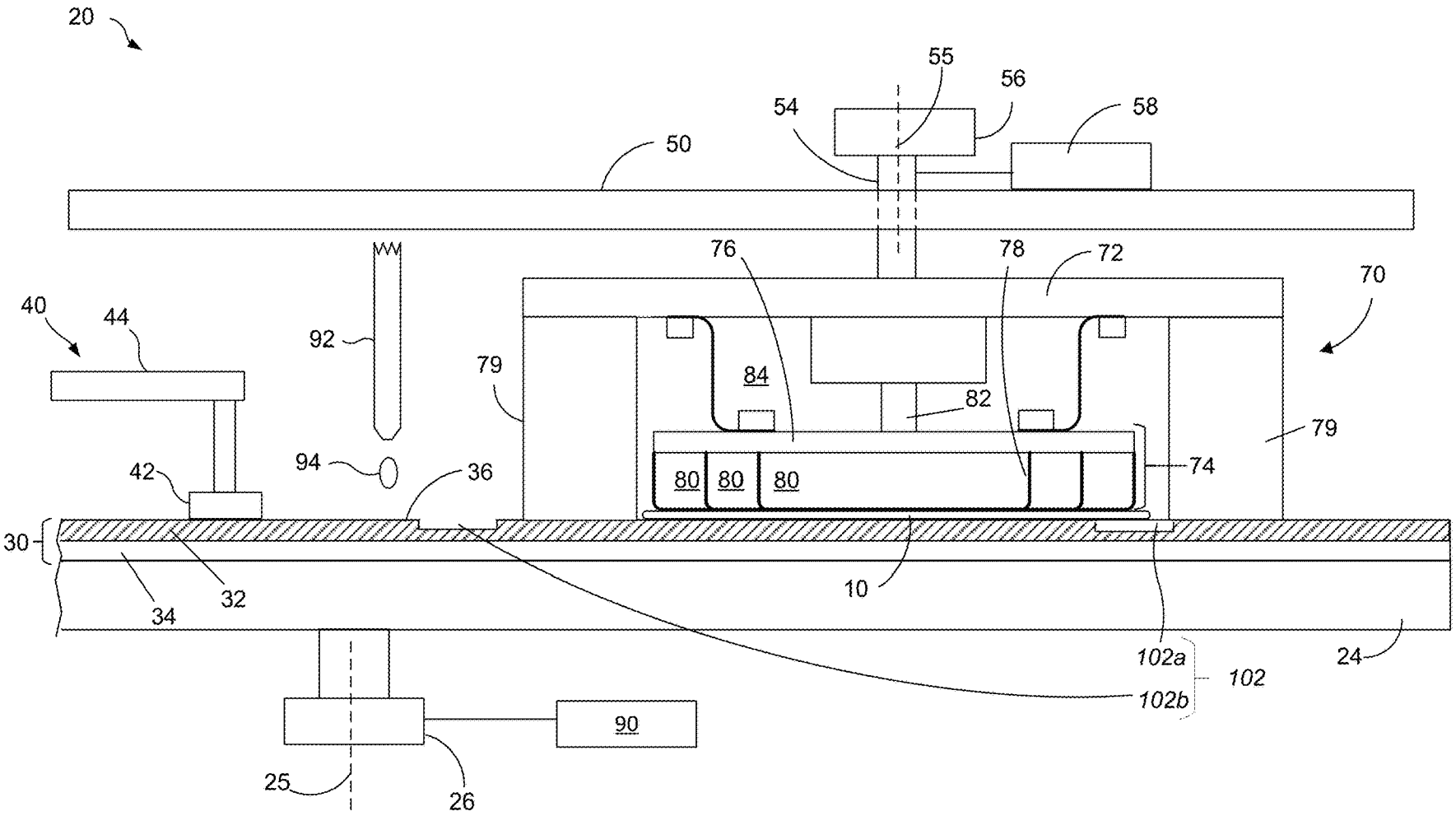
FIG. 1 is a schematic cross-sectional view of a chemical mechanical polishing system with a polishing pad having a polishing control groove.

FIG. 1 illustrates an example of a polishing station of a chemical mechanical polishing system 20. The polishing system 20 includes a rotatable disk-shaped platen 24 on which a polishing pad 30 is situated. The platen 24 is operable to rotate about an axis 25. For example, a motor 26 can turn a drive shaft 28 to rotate the platen 24. The polishing pad 30 can be a two-layer polishing pad with an outer polishing layer 32 and a softer backing layer 34. The outer polishing layer 32 has a polishing surface 36.

The polishing system 20 can include a supply port or a combined supply-rinse arm 92 to dispense a polishing liquid 94, such as an abrasive slurry, onto the polishing pad 30. The polishing system 20 can include a pad conditioner apparatus 40 with a conditioning disk 42 to maintain the surface roughness of the polishing surface 36 of the polishing pad 30. The conditioning disk 42 can be positioned at the end of an arm 44 that can swing so as to sweep the disk 42 radially across the polishing pad 30.

A carrier head 70 is operable to hold a substrate 10 against the polishing pad 30. The carrier head 70 is suspended from a support structure 50, e.g., a carousel or a track, and is connected by a drive shaft 58 to a carrier head rotation motor 56 so that the carrier head can rotate about an axis 55. The carrier head 70 can oscillate laterally, e.g., on sliders on the carousel, by movement along the track, or by rotational oscillation of the carousel itself.

The carrier head 70 includes a housing 72, a substrate backing assembly 74 which includes a base 76 and a flexible membrane 78 that defines a plurality of pressurizable chambers 80, a gimbal mechanism 82 (which may be considered part of the assembly 74), a loading chamber 84, and a retaining ring assembly 79.

The housing 72 can generally be circular in shape and can be connected to the drive shaft 58 to rotate therewith during polishing. There may be passages (not illustrated) extending through the housing 72 for pneumatic control of the carrier head 70. The substrate backing assembly 74 is a vertically movable assembly located beneath the housing 72. The gimbal mechanism 82 permits the base 76 to gimbal relative to the housing 72 while preventing lateral motion of the base 76 relative to the housing 72. The loading chamber 84 is located between the housing 72 and the base 76 to apply a load, i.e., a downward pressure or weight, to the base 76 and thus to the substrate backing assembly. The vertical position of the substrate backing assembly 74 relative to a polishing pad is also controlled by the loading chamber 84. The lower surface of the flexible membrane 78 provides a mounting surface for a substrate 10.

In some implementation, the substrate backing assembly 74 is not a separate component that is movable relative to the housing 72. In this case, the chamber 84 and gimbal 82 are unnecessary.

Still referring to FIG. 1, the polishing pad 30 has at least one polishing control groove 102 formed in the polishing surface 36. Each polishing control groove 102 is a recessed area of the polishing pad 30. Each polishing control groove 102 can be an annular groove, e.g., circular, and can be concentric with the axis of rotation 25 of the platen 24. Each polishing control groove 102 provides an area of the polishing pad 30 that does not contribute to polishing.

The walls of the polishing control groove 102 are perpendicular to the polishing surface 36. The polishing control groove 102 can have a rectangular or a U-shaped cross-section. The polishing control groove 102 can be 10 to 80 mils, e.g., 10 to 60 mils, deep.

In some implementations, the pad 30 includes a polishing control groove 102*a* located near the outer edge of the polishing pad 30, e.g., within 15%, e.g., within 10%, e.g., within 5% (by radius) of the outer edge. For example, the groove 102 can be located at a radial distance of fourteen inches from the center of a platen having a thirty inch diameter.

In some implementations, the pad 30 includes a polishing control groove 102*b* located near the center of the polishing pad 30, e.g., within 15%, e.g., with 10% (by radius) of the center or axis of rotation 25. For example, the groove 102*b* can be located at a radial distance of one inch from the center of a platen having a thirty inch diameter.

Figure 3A:
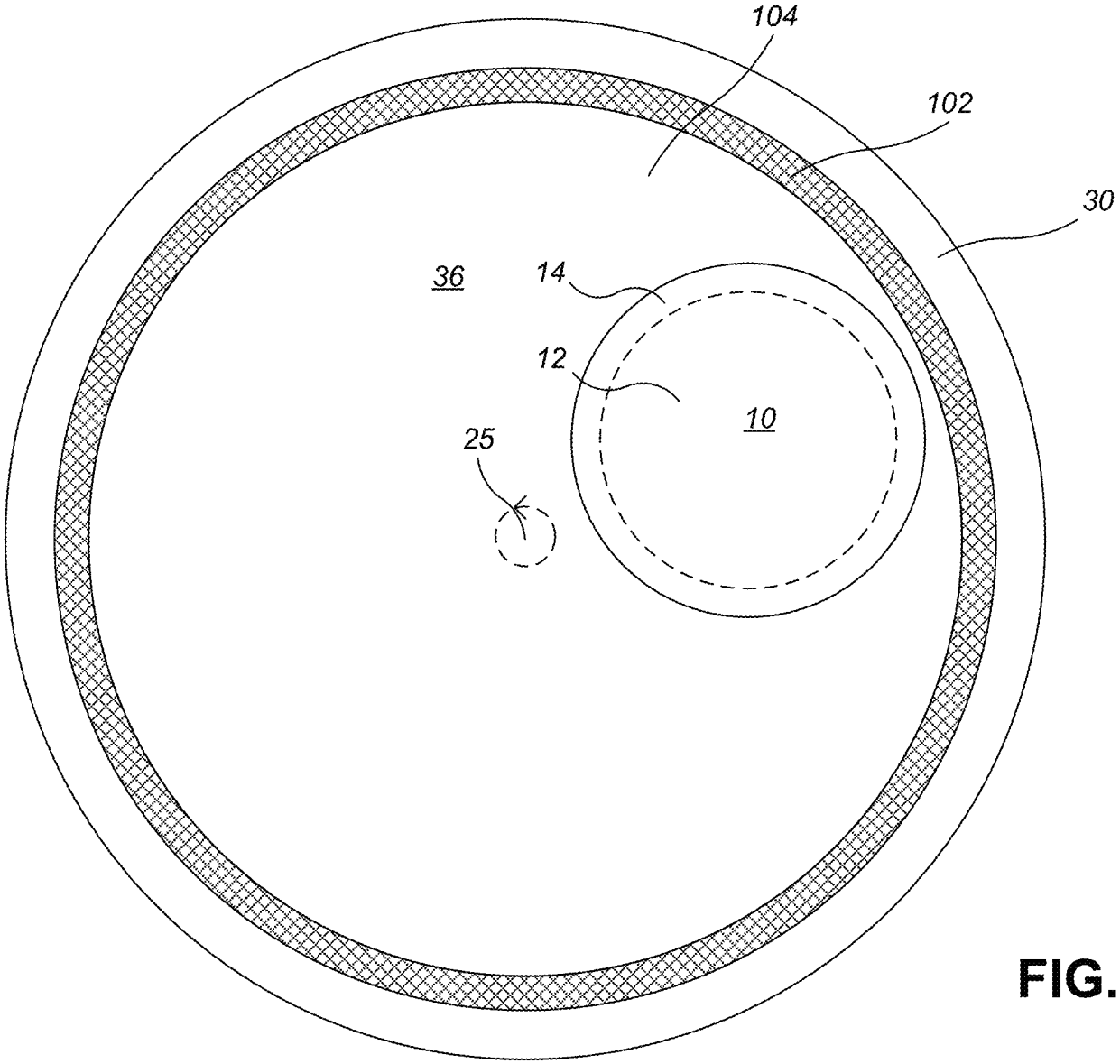
FIGS. 3A and 3B are a schematic top views of an example chemical mechanical polishing apparatus illustrating the carrier head at different lateral positions.
Figure 3B:
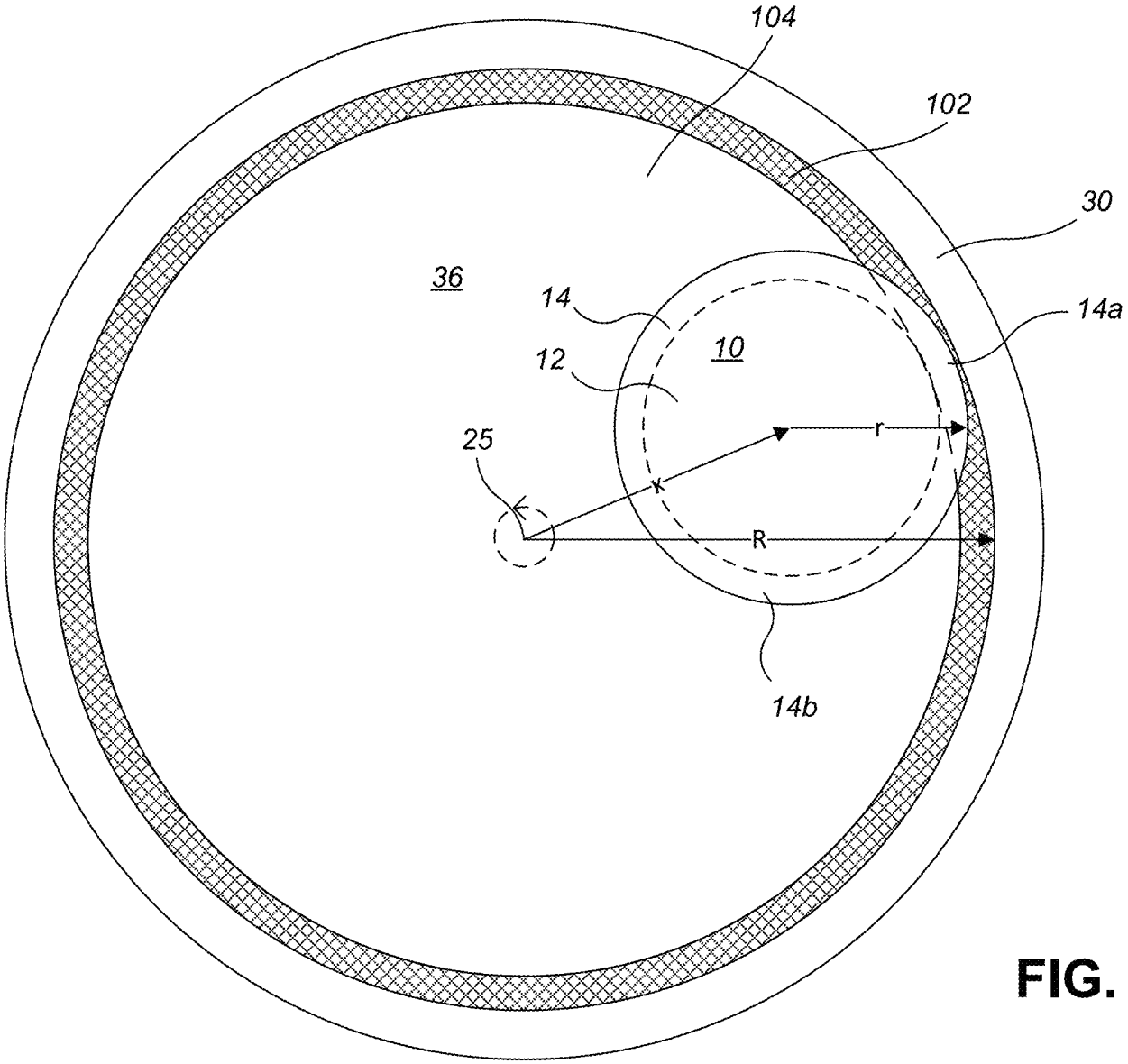

In some implementations, the pad 30 includes only a polishing control groove 102*a* located near the outer edge of the polishing pad 30 (see FIGS. 3A and 3B). In this case, there can be just a single control polishing groove 102*a* near the outer edge of the polishing pad 30. In some implementations, the pad 30 includes only a polishing control groove 102*b* located near the center of the polishing pad 30. In this case, there can be just a single control polishing groove 102*b* near the center of the polishing pad 30. In some implementations, the pad 30 includes a first polishing control groove 102*a* located near the edge of the polishing pad 30 and a first polishing control groove 102*b* located near the center of the polishing pad 30 (see FIG. 1). In this case, there can be exactly two polishing grooves 102 on the polishing surface.

The polishing control groove 102 is sufficiently wide that by positioning a section of the substrate 10 over the groove, the polishing rate of that section will be materially reduced. In particular, for edge-correction, the groove 102 is sufficiently wide that an annular band at the edge of the substrate, e.g., a band at least 3 mm wide, e.g., a band 3-15 mm wide, e.g., a band 3-10 mm wide, will have a reduced polishing rate. The polishing control groove 102 can be five to fifty millimeters wide, e.g., ten to twenty mm wide.

When the substrate 10 is positioned over the polishing surface 36 of the polishing pad 30, the polishing surface 36 contacts and polishes the substrate 10, and material removal takes place. On the other hand, when an edge of the substrate 10 is positioned above the polishing control groove 102, there is no contact or polishing of the edge of substrate 10 to cause removal takes place. Optionally, the groove 102 can provide a conduit for polishing slurry to pass through without abrading the substrate 10.

Figure 2:
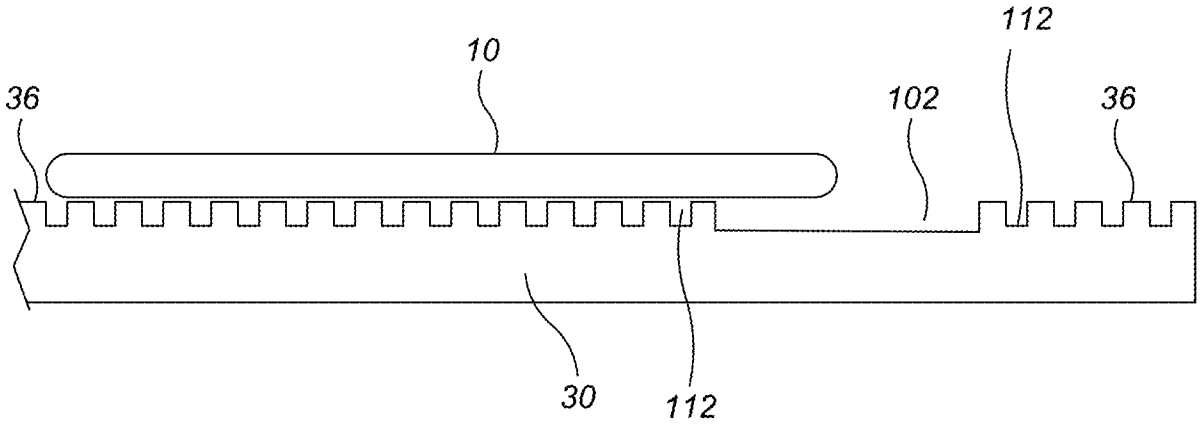
FIG. 2 is a schematic cross-sectional view of a radial section of a polishing pad having both slurry-supply grooves and a polishing control groove.

Referring now to FIG. 2, the polishing pad 30 can also include one or more slurry-supply grooves 112. The slurry-supply grooves 112 can be annular grooves, e.g., circular grooves, and can be concentric with the polishing control groove 102. Alternatively, the slurry supply grooves can have another pattern, e.g., rectangular cross-hatch, triangular cross-hatch, etc. The slurry supply grooves can have a width between about 0.015 and 0.04 inches (between 0.381 and 1.016 mm), such as 0.20 inches, and a pitch between about 0.09 and 0.24 inches, such as 0.12 inches.

The slurry-supply grooves 112 are narrower than the polishing control groove 102. For example, the slurry-supply grooves 112 can be narrower by a factor of at least 3, e.g., at least 6, such as 6 to 100. The slurry supply grooves 112 can be uniformly spaced across the polishing pad 30. The polishing control groove 102 can have a smaller, similar, or greater depth than the slurry-supply grooves 112. In some implementations, the polishing control groove 102 is the only groove on the polishing pad wider than the slurry supply grooves 112. In some implementations, the polishing control grooves 102*a* and 102*b* are the only grooves on the polishing pad wider than the slurry supply grooves 112.

Referring now to FIG. 3A, for at least some portion of the polishing operation, e.g., a first duration, the substrate 10 can be positioned in a first position or first range of positions such that the central portion 12 of the substrate 10 and the edge portion 14 of the substrate 10 are both polished by the polishing surface 36 of the polishing pad 30. As such, none of the substrate 10 overlaps the polishing control groove 102. Although portions of the substrate 10 overlap the slurry-supply grooves 112, the slurry-supply grooves 112 are relatively closely spaced and relative motion averages out any effects on the polishing rate.

Referring to FIG. 3B, for at least some portion of the polishing operation, e.g., for a second duration, the substrate 10 can be positioned such that the central portion 12 of the substrate 10 is polished by the polishing surface 36 and a region 14*a* of the edge portion 14 of the substrate 10 is above the polishing control groove 102. During the second duration, the substrate 10 can be held laterally fixed in a second position. Thus the central portion 12 of the substrate 10 is polished during the second duration, whereas a region 14*a* of the edge portion 14 of the substrate 10, positioned above the polishing control groove 102, is not polished. Since some of the edge portion 14 (indicated by 14*b*) remains over the polishing surface 36, the edge portion 14 will still be polished to some degree, but at a lower rate than the central portion 12 due to lack of polishing in region 14*a*. Although portions of the substrate 10 overlap the slurry-supply grooves 112, the slurry-supply grooves 112 are relatively closely spaced and relative motion averages out any effects on the polishing rate.

The particular amount of time that the region 14*a* of the edge portion 14 remains over the polishing control groove 102 depends on the frequency and magnitude of oscillation and the dimensions of the groove and substrate. A controller 90 (see FIG. 1) can control the motors 25 26, 56, to control the rotation rate of the platen 24 and carrier head 70, and can control the actuator 122 coupled to the support to control the frequency and magnitude of the lateral oscillation of the carrier head 70.

Figure 4:
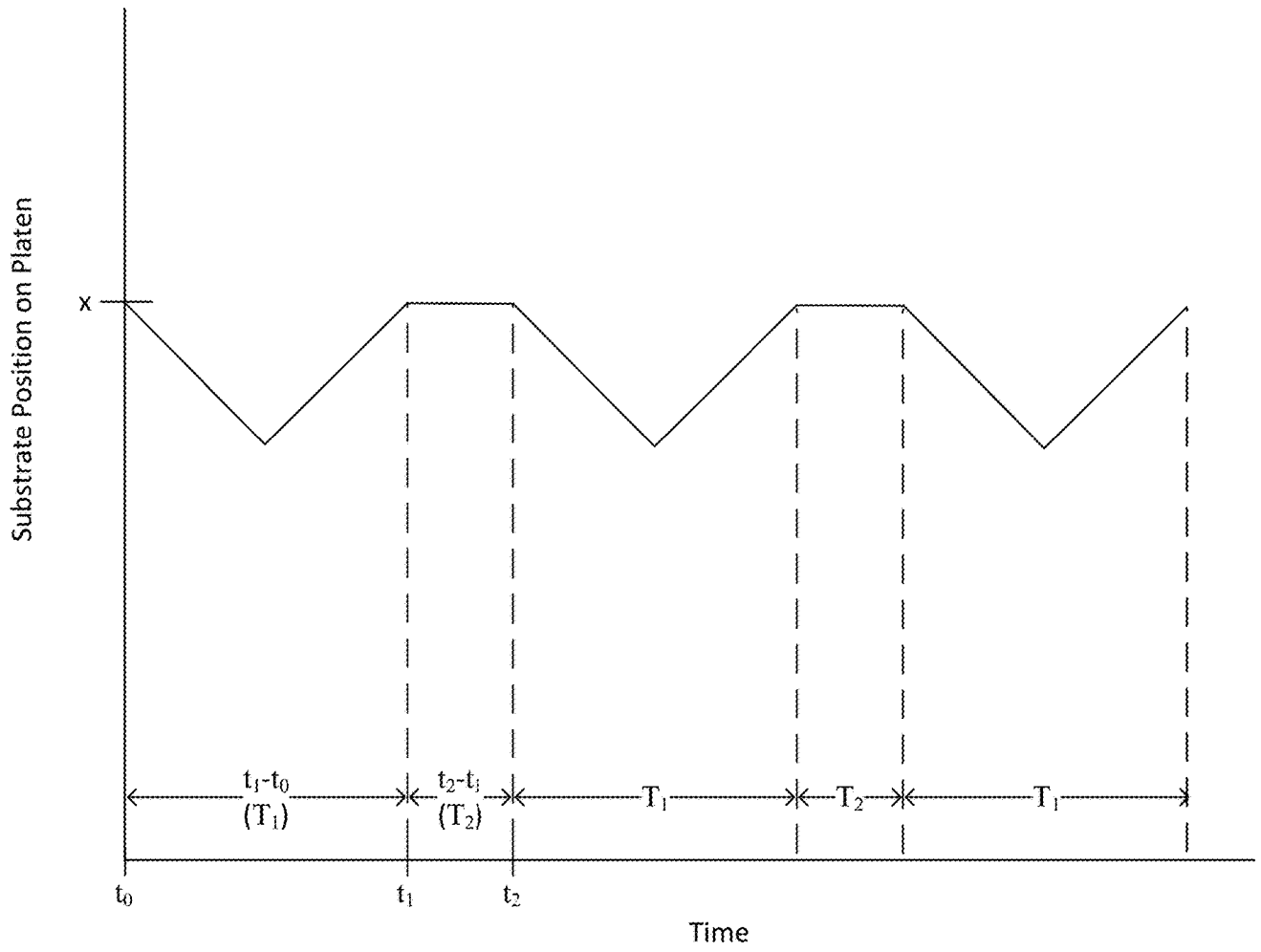
FIG. 4 is an exemplary graph of substrate position on platen versus time.

Referring to FIG. 4, the substrate can be moved in an oscillating pattern in which the substrate make a single sweep for a first duration $T_1$ ($t_0$ to $t_1$). In some implementations, at the end of the first duration, the substrate is held for a second duration $T_2$ ($t_1$ to $t_2$) in a position where the central portion 12 of the substrate 10 is positioned over the polishing area of the polishing pad 30 and the edge portion 14 of the substrate 10 is positioned and held over the polishing control groove 102. In this case the frequency of oscillation is $1/(T_1+T_2)$.

The ratio of the first duration $T_1$ to the second duration $T_2$ can be selected so as to reduce the polishing rate of the edge portion 14 by a desired amount as compared to the center portion 12. For example the ratio $T_1/T_2$, can be selected to achieve a desired average polishing rate at the edge, e.g., to achieve the same average polishing rate as the center portion 12.

Figure 5A:
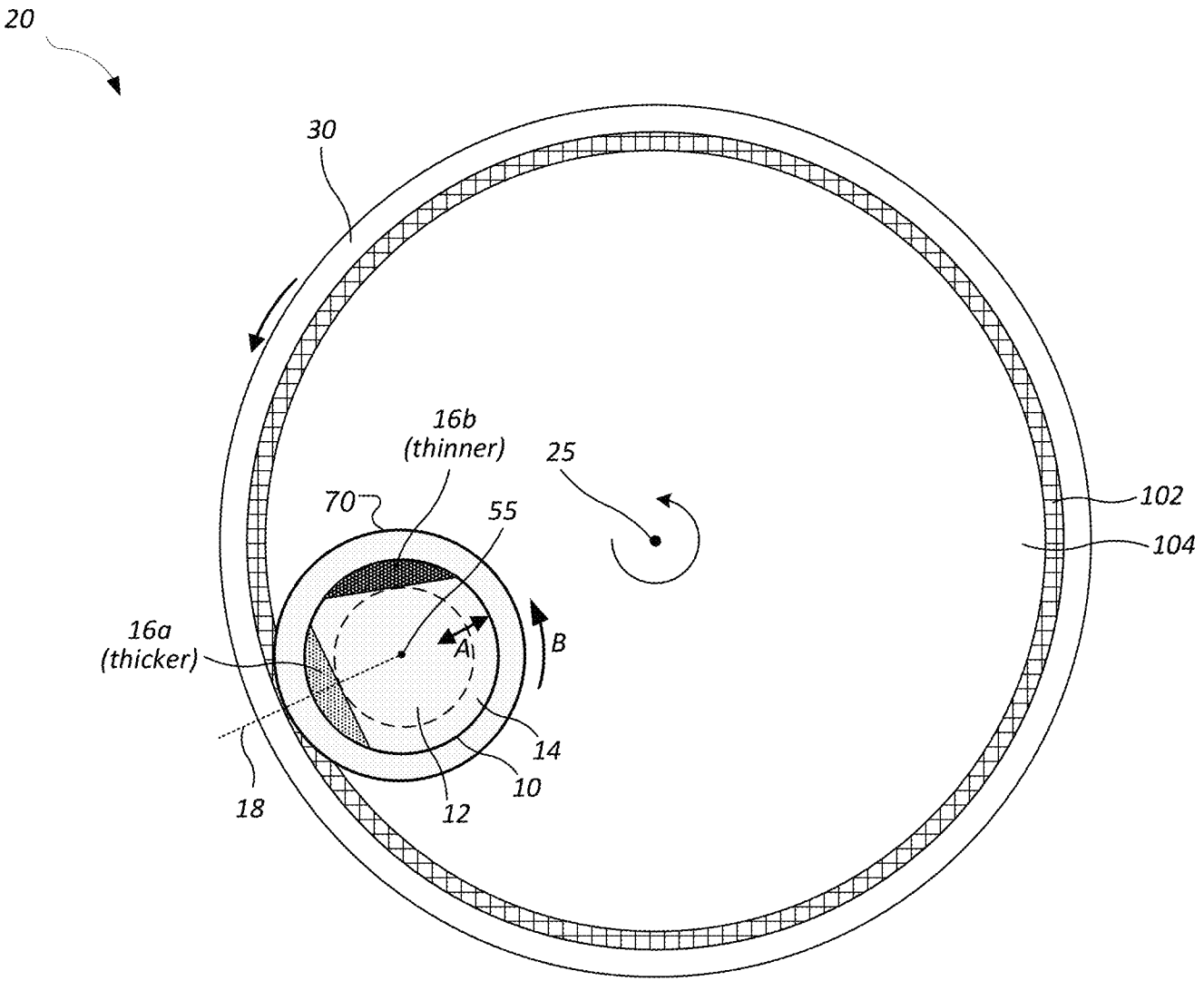
FIGS. 5A and 5B are schematic top views of a chemical mechanical polishing apparatus illustrating the carrier head at different lateral positions.

Referring to FIG. 5A, as noted above, the substrate can be subject to asymmetry. For example, the edge portion 14 of the substrate 10 can have a first angular swath 16*a* and a second angular swath 16*b*, each with different thicknesses. To compensate for edge asymmetry in the substrate 10, the controller 90 can cause the motion of the carrier head 70 to different swaths of the edge portion 14 of the substrate 10 either over the polishing control groove 102 or over the polishing area of the polishing pad 30. This can be done by synchronizing oscillation of the carrier head 70 with rotation of the carrier head 70. For example, each second duration $T_2$ corresponds to the time that the second angular swath 16*b* is over the polishing control groove 102.

For example, assuming the first angular swath 16*a* is thicker than the second angular swath 16*b*, the lateral position of the carrier head and the rotation of the carrier head can be synchronized such that when the first angular swath 16*a* of the substrate 10 is at a given azimuthal angular position 18 about the axis of rotation 55 of the carrier head 70, the carrier head 70 can be positioned such that the first angular swath 16*a* overlies the polishing portion 104 of the polishing pad 30. The azimuthal angular position 18 can be the position on the carrier head 70 farthest from the axis of rotation 25 of the polishing pad. Similarly, the azimuthal angular position 18 can be on a line that passes through the axis of rotation 25 of the polishing pad 30 and the axis of rotation 55 of the carrier head 70.

Figure 5B:
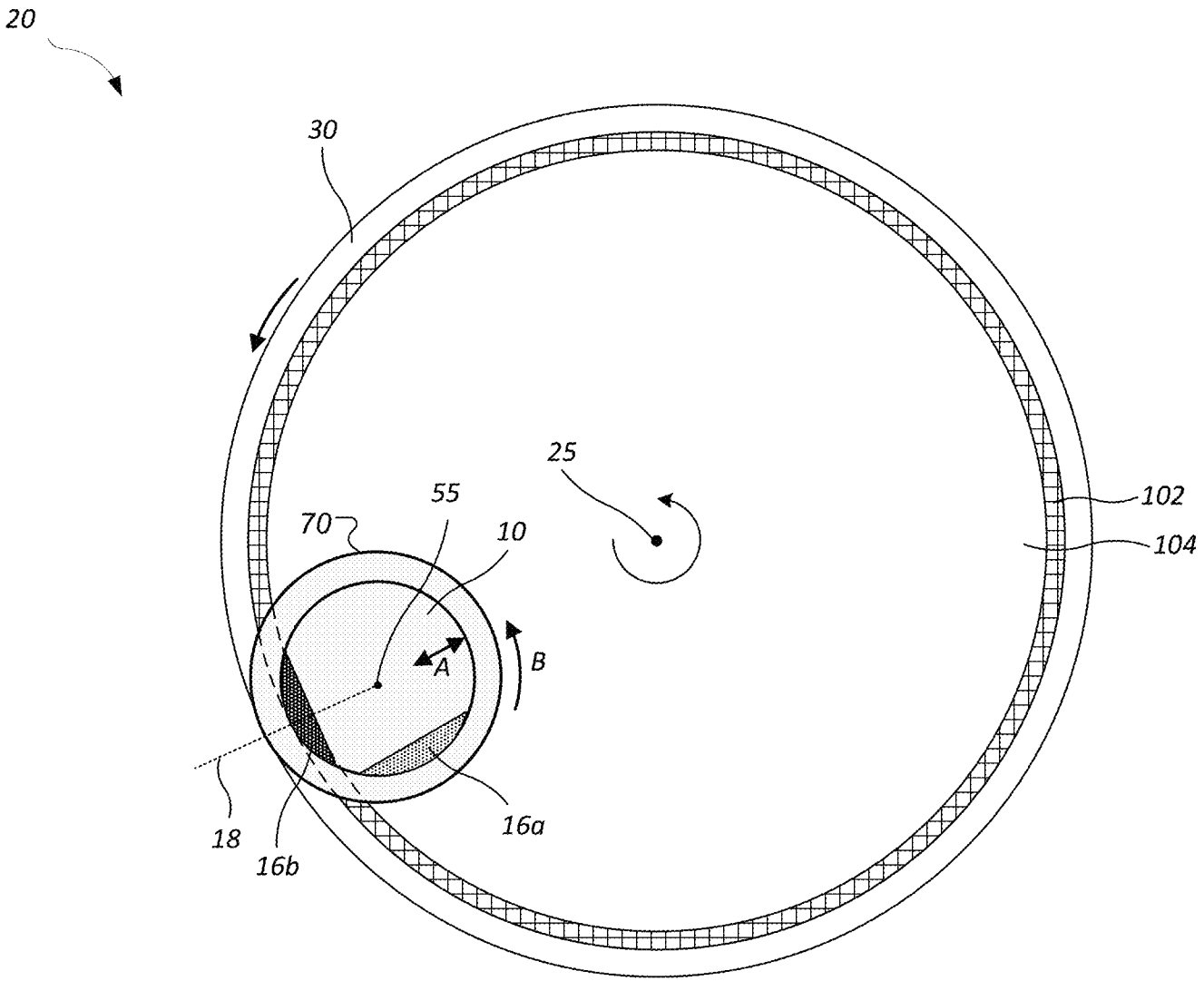

Referring to FIG. 5B, as the carrier head 70 rotates, the second angular swath 16*b* moves toward the given azimuthal angular position 18. The lateral position of the carrier head 70 and the rotation of the carrier head 70 can be synchronized such that by the time that the second angular swath 16*b* is the given azimuthal angular position 18 about the axis of rotation 55 of the carrier head 70, the carrier head 70 has moved laterally such that the second angular swath 16*b* overlies the polishing control groove 102. As a result, the first angular swath 16*a* is polished at a higher rate than the second angular swath 16*b*. This can provide a more uniform substrate 10, and in particular can reduce edge asymmetry.

To provide the synchronization, the controller 90 can be configured to control the motor 26 and the actuator 58 such that a first frequency of rotation of the carrier head is equal to an integer multiple of a second frequency of lateral oscillation of the carrier head. For example, the first frequency of rotation can be equal to second frequency. It may be noted that this synchronization must be maintained fairly precisely; a mismatch will result in precession of the angular swaths relative to the given azimuthal angular position 18, and thus ender the edge asymmetry correction ineffective.

Although FIG. 4 illustrates the substrate being held in position for a second duration $T_2$, this is not necessary. Even if the carrier head 70 is sweeping continuously back and forth across the polishing pad 30, e.g., a radial position that is a triangular or sinusoidal function of time, there can be some period of time when the second angular swath 16*b* overlies the polishing control groove 102

In addition, although the discussion above focuses on a polishing pad having a single polishing control groove 102*a* near the outer perimeter of the polishing pad, similar principles can be applied if a polishing grove 120*b* is positioned near the center of the polishing pad so that the otherwise overpolished second angular swath 16*b* is placed over the polishing control groove 102*b* in order to reduce the polishing rate of that swath.

Figure 6A:
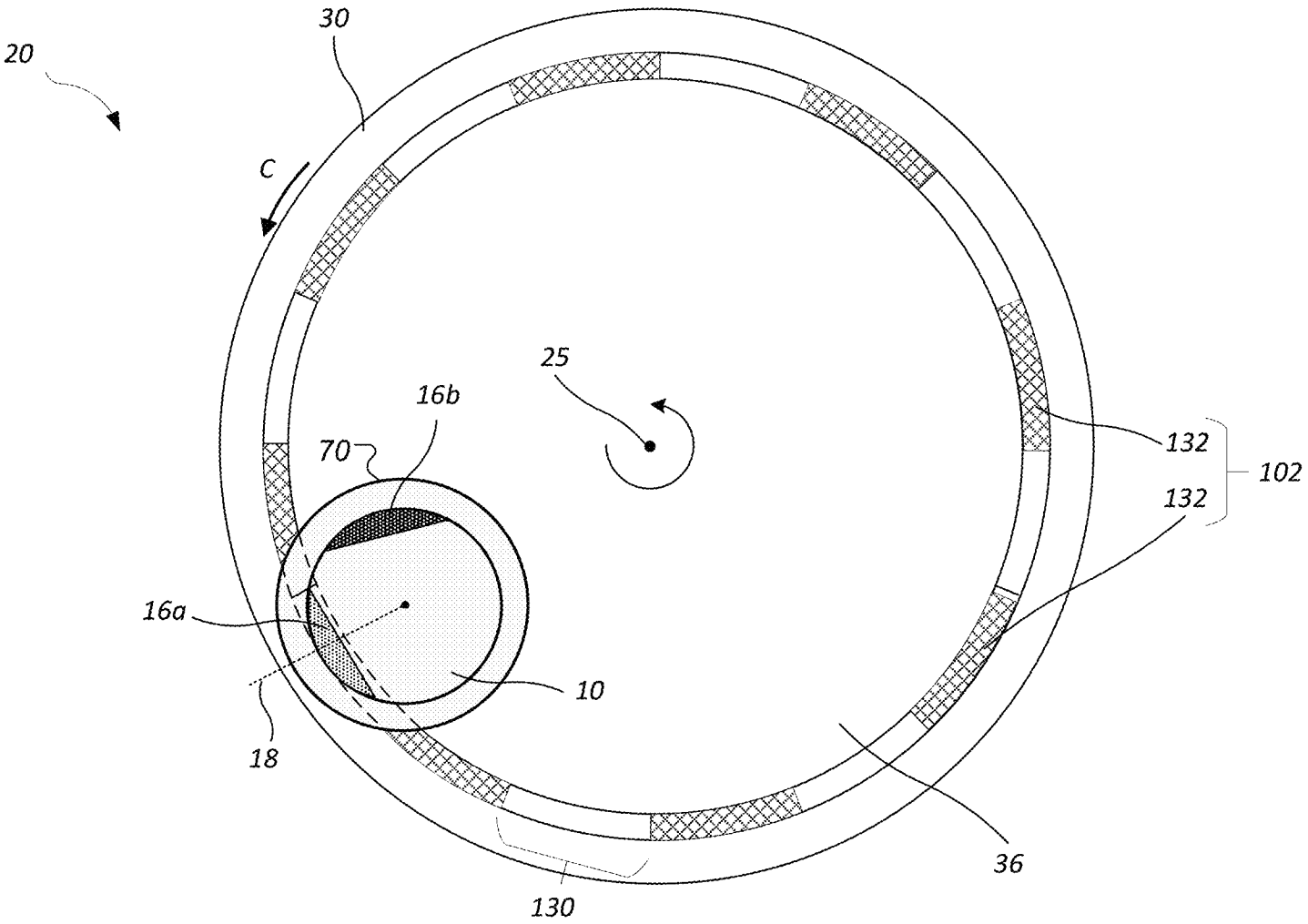
FIGS. 6A and 6B are schematic top views of another implementation of a chemical mechanical polishing apparatus illustrating the carrier head at different lateral positions.
Figure 6B:
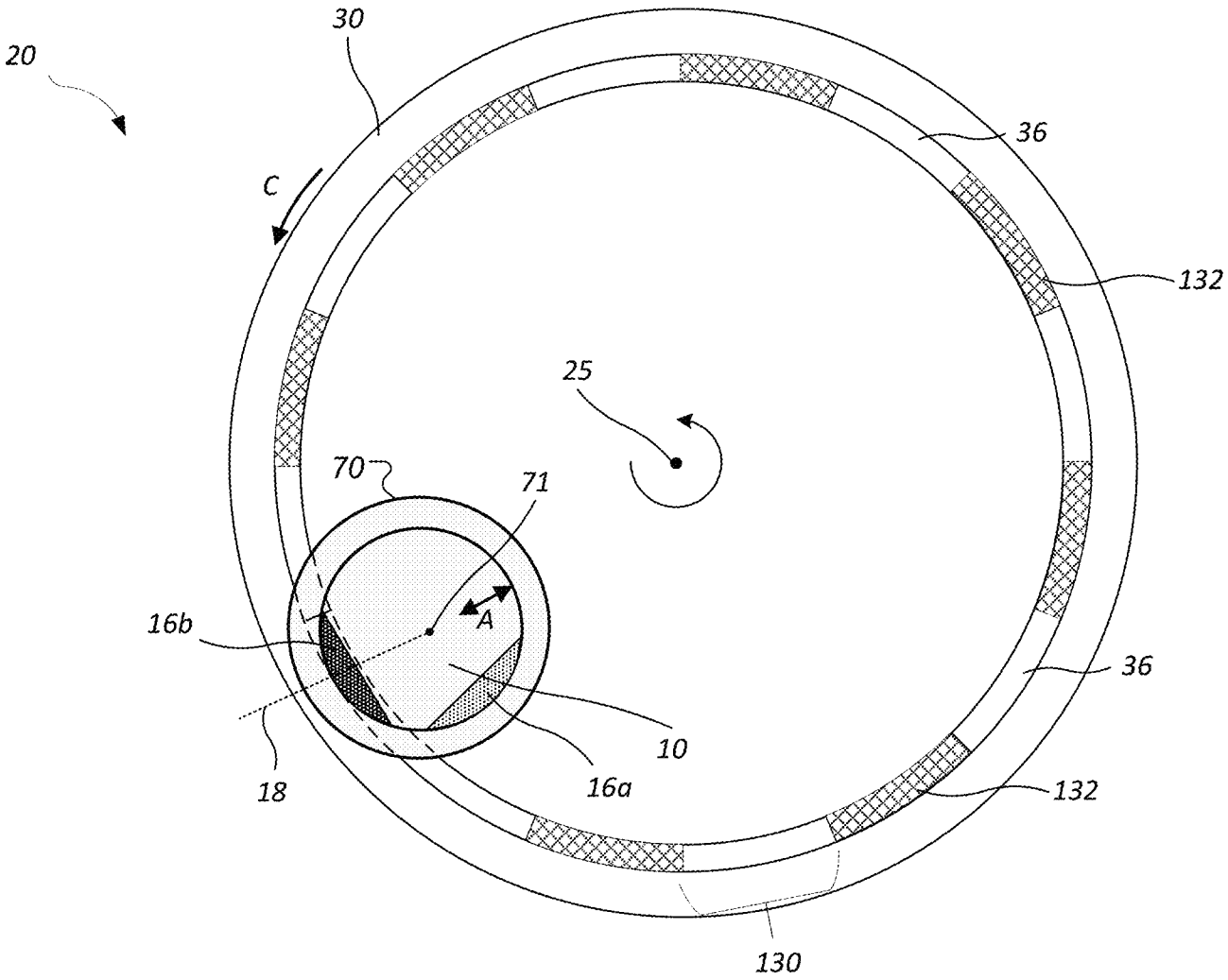

Referring to FIGS. 6A and 6B, in some implementations, the polishing control groove 102 can include a plurality of arcuate segments 132 (rather than being a continuous circle). There can be four to twenty arcuate segments 132. The arcuate segments 132 can be spaced at equal angular intervals around the axis of rotation 25 of the platen. The arcuate segments 132 can have equal lengths. Each arcuate segment can subtend an arc of 15-90°.

The controller 90 can synchronize the rotation of the carrier head 70 and the rotation of platen 24 and the polishing pad 30 (shown by arrow C) so as to reduce the polishing rate on regions of the substrate that are overpolished. In this configuration, lateral sweep of the carrier head 70 is unnecessary to achieve compensation for edge asymmetry.

For example, if the first angular swath 16*a* of the edge portion 14 of the substrate 10 is thicker than the second angular swath 16*b*, polishing can begin with the first angular swath 16*a* overlying a section 130 of the polishing surface 36 between the arcuate segments 132 of the groove. As the both the polishing pad 30 and carrier head 70 rotate, the second angular swath 16*b* moves outwardly toward the radius at which the arcuate segments are positioned. The controller 90 can synchronize the rotation of carrier head 70 and the rotation of the polishing pad 30 such that when the second angular swath 16*b* reaches the radial position of the groove 102, the second angular swath 16*b* overlies one of the arcuate segments 132. As a result, the first angular swath 16*a* can be polished at a higher rate than the second angular swath 16*b*, and thus edge asymmetry can be reduced and uniformity improved.

To provide the synchronization, the controller 90 can be configured to control the motors 26, 56 that a first frequency of rotation of the carrier head is equal to an integer multiple of a second frequency of rotation of the platen. For example, the first frequency of rotation can be equal to N, where N is a factor of the number of arcuate segments 132. In some implementations, N is equal to one. It may be noted that this synchronization must be maintained fairly precisely; a mismatch will result in precession of the angular swaths relative to the given azimuthal angular position 18, and thus ender the edge asymmetry correction ineffective.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The controller 90 can include a dedicated microprocessor, e.g., an ASIC, or a conventional computer system executing a computer program stored in a non-volatile computer readable medium. The controller 90 can include a central processor unit (CPU) and memory containing the associated control software.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A chemical mechanical polishing system comprising:

a rotatable platen to hold a polishing pad, the platen rotatable by a motor, the polishing pad having a polishing surface and a polishing control groove concentric with an axis of rotation for the polishing pad;

a rotatable carrier head to hold a substrate against the polishing surface of the polishing pad during a polishing process, the carrier head laterally movable by a first actuator across the polishing pad and rotatable by a second actuator; and a controller configured to control the first actuator and the second actuator such that lateral oscillation of the carrier head is synchronized with rotation of the carrier head and over a plurality of successive oscillations of the carrier head when a first angular swath of an edge portion of the substrate is at an azimuthal angular position about an axis of rotation of the carrier head the first angular swath overlies the polishing surface, a second angular swath of the edge portion of the substrate, otherwise over-polished relative to the first angular swath, is at the azimuthal angular position the second angular swath overlies the polishing control groove.

2. The system of claim 1, wherein the polishing pad further comprises slurry-supply grooves.

3. The system of claim 2, wherein the slurry supply grooves are narrower than the polishing control groove.

4. The system of claim 3, wherein the polishing pad has a single polishing control groove surrounding the slurry supply grooves.

5. The system of claim 3, wherein the polishing pad has a single polishing control groove surrounded by the slurry supply grooves.

6. The system of claim 3, wherein the polishing pad has exactly two polishing control grooves and the slurry supply grooves are positioned between the two polishing control grooves.

7. The system of claim 1, wherein the controller is configured to control the first actuator and the second actuator such that a first frequency of rotation of the carrier head is equal to an integer multiple of a second frequency of lateral oscillation of the carrier head.

8. A chemical mechanical polishing system comprising:

a rotatable platen to hold a polishing pad, the platen rotatable by a motor, the polishing pad having a polishing surface and a polishing control groove concentric with an axis of rotation for the polishing pad, the polishing control groove having a plurality of arcuate segments;

a rotatable carrier head to hold a substrate against the polishing surface of the polishing pad during a polishing process, the carrier head rotatable by an actuator; and a controller configured to control the motor and the actuator such that rotation of the platen is synchronized with rotation of the carrier head, and over a plurality of successive rotations of the carrier head when a first angular swath of an edge portion of the substrate is at an azimuthal angular position about an axis of rotation for the carrier head the first angular swath overlies a region of the polishing surface between the plurality of arcuate segments a second angular swath of the edge portion of the substrate, otherwise over-polished relative to the first angular swath, is at the azimuthal angular position the second angular swath overlies an arcuate segment of the polishing control groove.

9. The system of claim 8, wherein each arcuate segment of the plurality of arcuate segments is spaced at equal angular intervals around the axis of rotation of the platen.

10. The system of claim 8, wherein each arcuate segment of the plurality of arcuate segments has an equal length.

11. The system of claim 8, wherein each arcuate segment of the plurality of arcuate segments subtends an arc of 5-15°.

12. The system of claim 8, wherein there are four to twenty arcuate segments.

13. The system of claim 8, wherein the polishing pad further comprises slurry-supply grooves.

14. The system of claim 13, wherein the slurry supply grooves are narrower than the polishing control groove.

15. The system of claim 8, wherein the controller is configured to control the motor and the actuator such that a first frequency of rotation of the carrier head is an integer multiple of a second frequency of rotation of the platen.

16. A method for chemical mechanical polishing comprising: rotating a polishing pad about an axis of rotation;

positioning a substrate against the polishing pad, the polishing pad having a polishing surface and a polishing control groove concentric with the axis of rotation; and oscillating the substrate laterally across the polishing pad and rotating the substrate such that, over a plurality of successive rotations of the polishing pad, a first edge portion of the substrate is positioned over a polishing surface and a second edge portion of the substrate, otherwise over-polished relative to the first edge portion, is positioned over the polishing control groove to compensate for edge asymmetry in the substrate.

17. The method of claim 16, wherein a first frequency of rotation of the substrate is equal to an integer multiple of a second frequency of lateral oscillation of the substrate.

18. A method for chemical mechanical polishing comprising:

rotating a polishing pad about an axis of rotation;

positioning a substrate against the polishing pad, the polishing pad having a polishing surface and a polishing control groove concentric with the axis of rotation, the polishing control groove having a plurality of arcuate segments; and rotating the substrate such that over a plurality of successive rotations of the polishing pad a first edge portion of the substrate is positioned over a portion of the polishing surface between arcuate segments and a second edge portion of the substrate is positioned over an arcuate segment of the polishing control groove to compensate for edge asymmetry in the substrate.

19. The method of claim 18, wherein a first frequency of rotation of the substrate is equal to an integer multiple of a second frequency of rotation of the polishing pad.

* * * * *